US011247359B2

(12) United States Patent
Landwehr

(10) Patent No.: US 11,247,359 B2
(45) Date of Patent: Feb. 15, 2022

(54) SAFETY KNIFE

(71) Applicant: Thomas Jay Landwehr, DePere, WI (US)

(72) Inventor: Thomas Jay Landwehr, DePere, WI (US)

(73) Assignee: RITESAFETY PRODUCTS, INT'L., Depere, WI (US)

( * ) Notice: Subject to any disclaimer, the term of this patent is extended or adjusted under 35 U.S.C. 154(b) by 0 days.

(21) Appl. No.: 16/930,881

(22) Filed: Jul. 16, 2020

(65) Prior Publication Data

US 2022/0016797 A1 Jan. 20, 2022

(51) Int. Cl.
*B26B 29/02* (2006.01)
*B26B 5/00* (2006.01)

(52) U.S. Cl.
CPC ..... *B26B 29/02* (2013.01); *B26B 5/005* (2013.01)

(58) Field of Classification Search
USPC ..... 30/2; D8/98
See application file for complete search history.

(56) References Cited

U.S. PATENT DOCUMENTS

D571,180 S * 6/2008 Marshall ..... D8/98
8,782,909 B1 * 7/2014 Davis ..... B26B 1/08 30/280
10,493,645 B2 * 12/2019 Marinovich ..... B26B 3/08
10,618,188 B1 * 4/2020 Davis ..... B26B 29/06
D904,153 S * 12/2020 Rus ..... D8/98
10,926,428 B2 * 2/2021 Nguyen ..... B26B 29/06
10,953,557 B2 * 3/2021 Davis ..... B26B 11/00
2010/0263219 A1 * 10/2010 Kempker ..... B25F 1/02 30/337
2015/0298330 A1 * 10/2015 Yu Chen ..... B26B 27/005 30/280
2017/0197320 A1 * 7/2017 Chen ..... B26B 11/006
2017/0203449 A1 * 7/2017 Davis ..... B26B 1/08
2018/0229380 A1 * 8/2018 Gringer ..... B26B 27/005

* cited by examiner

*Primary Examiner* — Hwei-Siu G Payer
(74) *Attorney, Agent, or Firm* — Donald J. Ersler

(57) ABSTRACT

Safety knife with a blade that can be replaced and where access to the cutting edge of the blade is limited so as to reduce the risk of injury to a user, comprising a blade piece with a blade arranged between a guard and a fixation and an oblong knife body comprising a holder and a partly flat insert for rigidly holding the blade piece near a proximal end, wherein said insert having rails on both sides of the flat part at least near the proximal end, said holder including a depression near the proximal end for receiving the fixation and a channel extending from the proximal end towards the distal end at least beyond the depression for receiving at least the flat part of the insert, said channel having grooves on each side starting at the proximal end for receiving the rails.

14 Claims, 2 Drawing Sheets

SAFETY KNIFE

FIELD OF THE INVENTION

The present invention relates to a safety knife with a blade that can be replaced, specifically a safety knife where access to the cutting edge of the blade is limited so as to reduce the risk of injury to a user.

BACKGROUND OF THE INVENTION

Many designs of knives providing limited access to the cutting edge of the blade are known, this is generally achieved by providing a guard on the distal end of the blade, spaced at a small distance from the body of the knife at the proximal end of the blade. The distance between the guard and the body of the knife is selected in such a manner that the fingers or other body parts of the user cannot fit in between, effectively preventing the cutting edge of the blade from coming into contact with the user.

In order to reduce the resistance when the blade is cutting through the material it is most advantageous if the blade is completely exposed from the cutting edge side to the opposite or top edge of the blade. To achieve this the guard is connected to the distal end of the blade and the proximal end blade is connected to the body of the knife. These connections must be strong enough to withstand the forces occurring when the blade is cutting through tough material. For knives with blades that can be replaced these connections are a challenge and often are not rigid enough to allow the user to perform many cuts efficiently and increase the risk of other injuries, such as repetitive motion injuries or injuries due to excessive force required to make a cut. In other cases the connections are complicated and require the use of special tools or a complex replacement procedure.

An additional issue in some designs is that the replacement of the blade requires handling of the blade in a manner which puts the user at risk as the cutting edge of the blade is exposed during the replacement procedure.

Due to these problems and the fact that production of disposable knives with a simple design is very cost effective leads to the current situation, where disposable knives are commonly used instead of the costly knives with blades that can be replaced.

SUMMARY OF THE INVENTION

It is an object of the present invention to provide a cost effective design of a safety knife with blades that can be easily and safely replaced and are connected to the body of the knife in a simple and rigid manner.

Another object of the present invention is to provide a clean, robust and cheap knife with disposable blades.

It is a further object of the present invention to provide a safety knife suitable for use with various types of disposable blades, depending on the type of material to be cut, e.g. boxes, sheet material on a roll, fabric or string.

DETAILED DESCRIPTION OF THE INVENTION

Figure 1A:
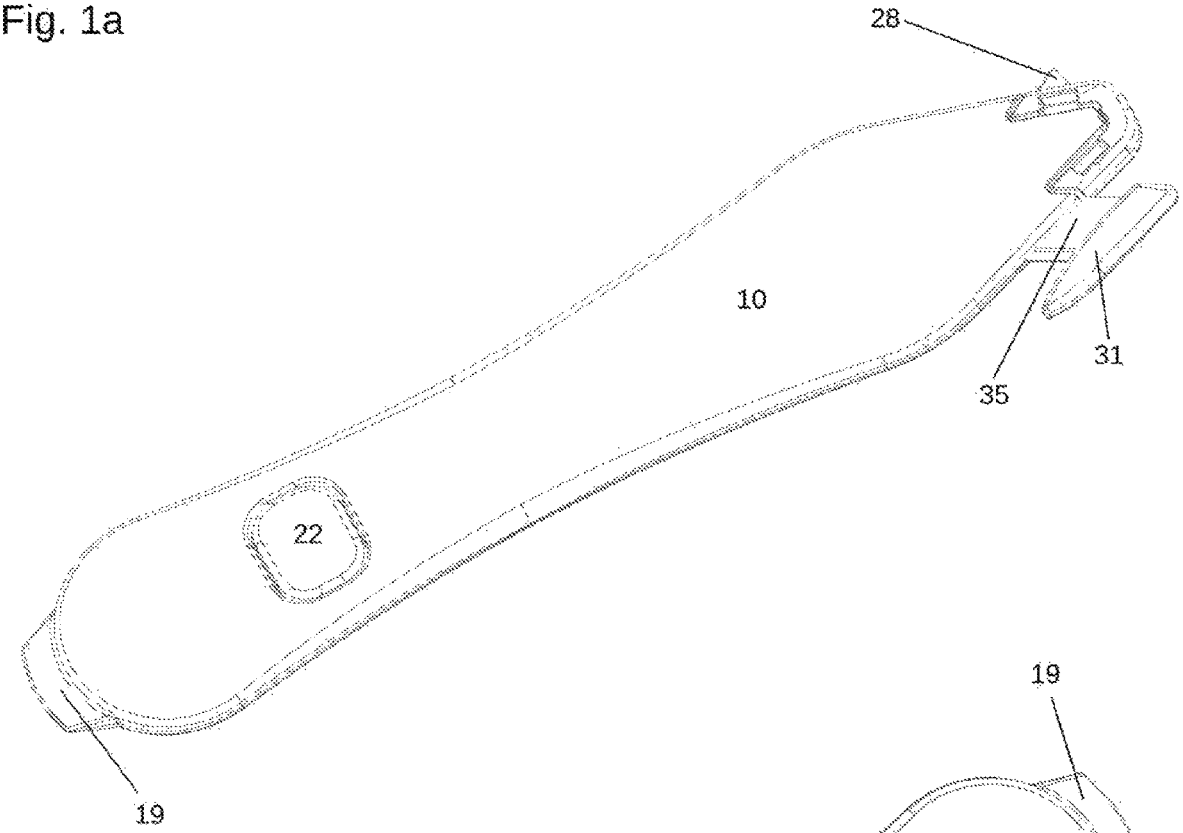
FIG. 1*a* is a perspective view of the front side of safety knife of the present invention
Figure 1B:
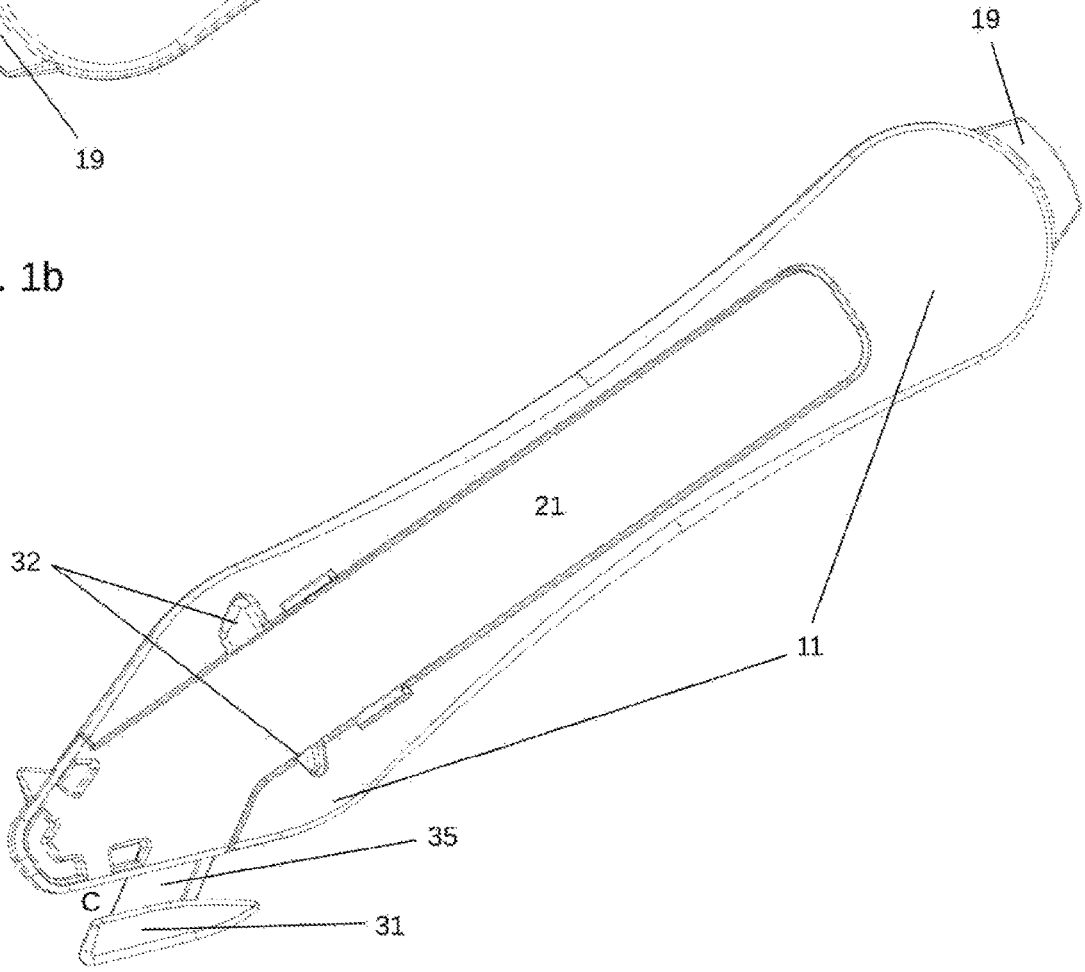
FIG. 1*b* is a view of the back side of the safety knife

Referring to FIG. 1*a* and FIG. 1*b* a safety knife 10 according to the present invention is shown as assembled. The insert 21 is placed into the holder 11 with the blade piece 30 rigidly fixed in between, such that only the guard 31 and a part of the cutting edge of the blade 35 extends from the knife body. In this manner the safety knife 10 is useful for cutting a variety of material such as paper, cardboard, fabric, plastic and other flat and/or firm objects. According to the invention the blade is located in a cutting channel C with essentially parallel sides through which the material of the object can pass easily. As can be seen in FIG. 1*b* the cutting channel C has a limited width, which is preferably less than the width of a finger of a user to prevent the user from accidentally coming into contact with the cutting edge of the blade 35.

Figure 2:
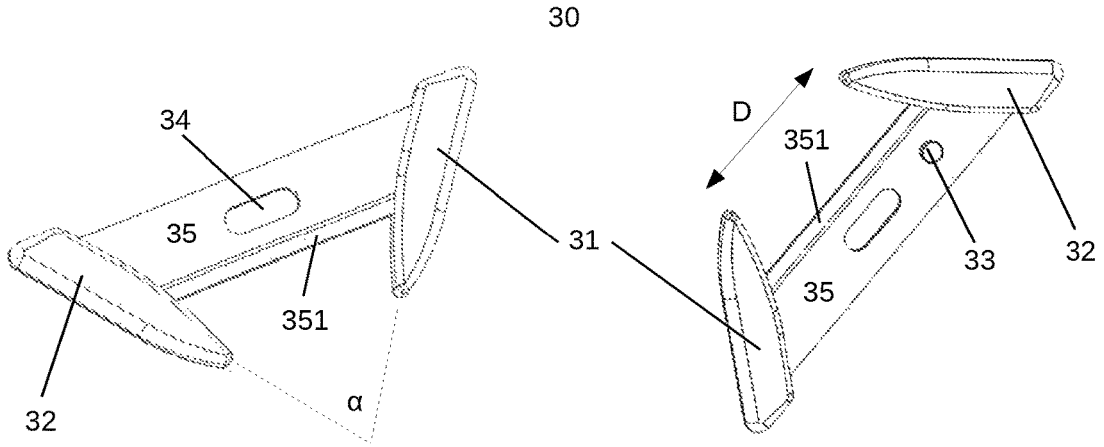
FIG. 2 is a front and rear view of the blade piece

In order to allow the blade piece 30 to be exchanged without the risk of injury the blade piece 30 comprises a guard 31 on one end of the cutting edge 351 and a fixation 32 on the other end as shown in FIG. 2. Both the guard 31 and the fixation 32 extend beyond the cutting edge 351 of the blade 35 to protect the user from accidental contact with the cutting edge 351, when handling the blade piece 30. In a preferred embodiment the distance D between the extensions of the guard 31 and the fixation 32 is less than the width of a finger of a user, essentially removing any risk of injury by the cutting edge. Ideally the guard 31 and the fixation 32 are arranged in a manner so that they point towards each other in the direction of the extensions, forming an angle $\alpha$ between 5 and 135 degrees as can be seen in FIG. 2.

Figure 3:
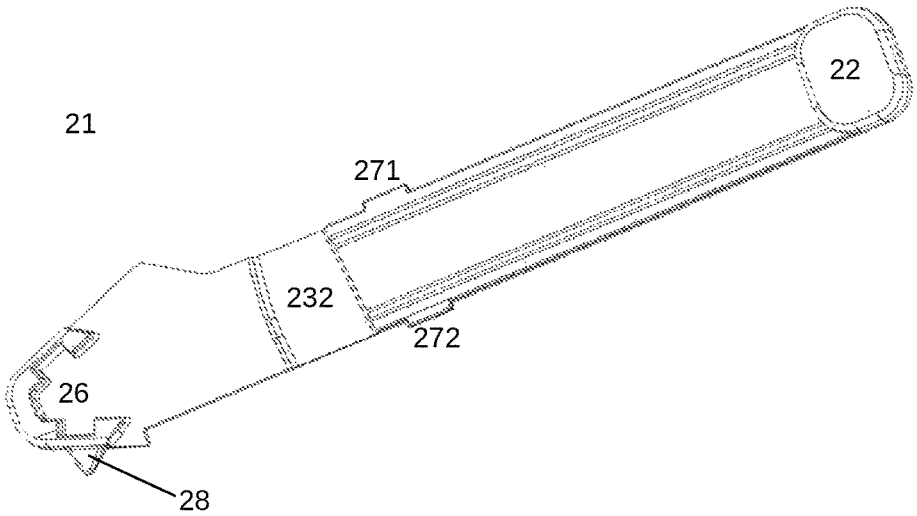
FIG. 3 is a view of the insert

The safety knife 10 consists of a holder 11, which fits into the user's hand and an insert 21 which can be connected to the holder 11 in such a manner that the blade piece 30 is rigidly held in between the two parts of the oblong knife body at the proximal end of the safety knife 10. The insert 21 is flat over most of the length with rails 271,272 at least near the proximal end and on both sides of the flat part as shown in FIG. 3. These rails 271,272 correspond to grooves 171,172 in the holder, which are located on both sides of a channel 121, which is designed to receive the flat part of the insert 21. The channel 121 extends from the proximal end of the holder towards the distal end, with the grooves 171,172 extending from the proximal end over a length required to allow the insert with the rails 271,272 to be moved all the way into the channel 121 in such a manner that a compact oblong knife body is formed from the holder 11 and the insert 21, perfectly adapted to fit in a user's hand.

A depression 132 is located near the proximal end of the holder, into which the fixation 32 of the blade piece 30 is placed holding the blade piece 30 in a fixed position as soon as the insert 21 is placed into the channel 121. By forming the depression 132 as the counterpart of the fixation 32 the blade piece 30 has no tolerance and is rigidly held at the desired position between the holder 11 and the insert 21.

In a further embodiment the insert 21 includes a catch 22 at the distal end protruding towards the holder 11 which corresponds to an opening 122 in the holder 11 designed to receive the catch 22. The catch 22 can be shaped as a button to allow easy operation by using a finger to push the button out of the opening 122 in the holder 11. The flat part of the insert 21 consists of a material which acts as a flat spring allowing the rails 271,272 of the insert 21 to slide in the grooves 171,172 while the catch 22 glides in the channel 121 until the opening 122 is reached and the spring forces the catch 22 into the opening 122.

Figure 4:
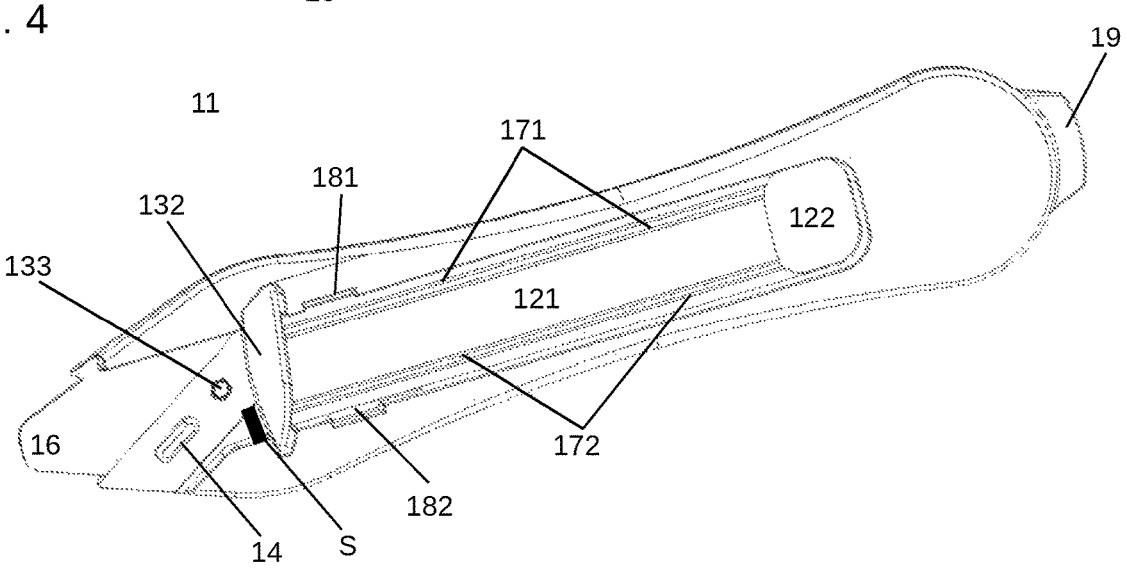
FIG. 4 is a view of the holder Preferred embodiments of the safety knife are described according to the drawings. These preferred embodiments are to be understood as exemplary embodiments and any detailed description shall not be interpreted as limiting. Alternate embodiments obvious to one skilled in the art will not be described in detail or will be omitted to prevent the relevant details of the invention to be overlooked.

In another embodiment the grooves 171,172 in the holder 11 have gaps 181,182 located behind the depression 132 in direction of the distal end as shown in FIG. 4. These gaps 181,182 have at least the length of the rails 271,272 which can be entered through the gaps 181,182 so that the flat spring is bent before sliding the insert 21 towards the distal end of the knife body. These gaps 181,182 provide an easy means to load the spring as opposed to trying to enter the rails 271,272 into the grooves 171,172 at the same time as holding the spring in the bent position.

The preferred embodiment of the invention features a blade piece 30, where the guard 31 and the fixation 32 have identical forms. In this way the blade piece 30 can be turned around and another section of the cutting edge 351 of the blade 35 can be used for cutting. This is convenient if the blade 35 has two different sections of the cutting edge 351, e.g. when one section is serrated, curved or otherwise specially designed. If no special configuration is required turning the blade 35 can be useful if the first section of the blade 35 is dull or broken, so that the blade 35 only needs to be replaced after both sections of the cutting edge 351 can no longer be used.

To allow flipping the blade piece 30 the insert 21 can include a cavity 232 near the proximal end for receiving the fixation 32. This cavity 232 should have dimensions larger than the fixation 32, to prevent the proximal end of the insert 21 from being bent while sliding the insert 21 into the holder 11.

In a preferred embodiment as seen in FIG. 3 the insert 21 has a recess 26 at the proximal end which engages with the tip 16 of the holder 11 when the insert 21 is slid into its final position forming the knife body. This prevents the front of the insert 21 and/or the front of the holder 11 from becoming disengaged when the safety knife 10 is in use.

The blade piece 30 can be additionally fixed in the safety knife 10 if the blade 35 has a hole or a slot 34 and the holder 11 is equipped with a bulge 14 precisely fitting into the hole or slot 34 (FIG. 4). Using this additional means for fixing the blade piece 30 to the knife body provides a strong rigidity, allowing the user to apply a large force when cutting, without the risk of the blade moving with respect to the handle or possibly even falling out of the knife body.

In another embodiment a pin or disk 133 is positioned on the holder 11 for holding the blade 35 to prevent the blade piece 30 from falling off the holder 11 before the insert 21 is completely placed onto the holder 11. In this embodiment the pin or disk 133 is made of magnetic and/or sticky material, while the corresponding part of the blade is made of metal or can be formed as a hole 33 in the blade 35. In the alternative the pin 33 or the marked area on the blade can consist of the sticky and/or magnetic material, while the disk or hole 133 on the holder 11 is made of or contains metal.

With adjustments to the design of the knife, e.g. with a depression 132 larger than the fixation 32 and a partial bulge 14, which does not completely fill the hole 34, the blade piece 30 can be moveable within the assembled knife. This movement can allow a wider channel C for the material to be cut during the cut and, if equipped with a spring S between the holder and the fixation, the blade piece 30 is permanently forced back into the knife to the original position and will return to this safer location after the cut is completed.

In other embodiments the blade piece 30 can be fully symmetrical or the angles formed between the guard 31 and fixation 32 to the cutting edge 351 can vary, allowing different angles of the cutting edge when cutting an object. Ideally the cutting edge of the blade is inclined at an angle of 11 degrees to the axis perpendicular to the length of the knife body.

The use of different kinds of blade pieces 30 allows the use of the safety knife 10 for a wide variety of objects, depending on the type and arrangement of the material to be cut. Some possible uses are for cutting boxes, sheet material both in stacks or wound up on a roll, loose or stretched fabric and/or various kinds an thicknesses of strings.

In the preferred embodiment for a box cutting tool the angle formed by the cutting edge of the blade and the holder is an obtuse angle as opposed to most currently available similar safety knives. This allows the knife to move away from the box, preventing the guard 31 and parts of the blade 35 from entering into the box and scratching or cutting the contents. In this embodiment the guard 31 is preferably designed as a thin long wedge.

In order to puncture the box before making the first cut the safety knife is further equipped with a piercing tool 28 located either at the distal end of the holder or at the proximal end on the opposite side from the blade piece with essentially the same shape as the front end of the guard 31. By initially puncturing the box the front end of the guard 31 can be easily entered into the hole created by the piercing tool 28, before initiating the cut.

It may also be useful to have a wide flat prying tool 19, which can be located at the distal end of the handle, e.g. to pry open a partially open box.

This description and the accompanying drawings show exemplary embodiments of the invention. The invention, however, should not be interpreted as being limited to these particular embodiments. Variations of the embodiments can be made by those skilled in the art without departing from the scope of this invention as defined by the claims.

The invention claimed is:

1. A safety knife comprising:

a blade piece having a guard, a fixation and a blade arranged between the guard and the fixation;

an oblong knife body comprising a holder and an insert with a flat part extending over most of a length of said insert for rigidly holding the blade piece near a proximal end of the oblong knife body, wherein said insert having rails on both sides of the flat part at least towards a proximal end of the insert;

said holder including a depression near a proximal end of the holder for receiving the fixation; and a channel extending from the proximal end of the holder towards a distal end of the holder at least beyond the depression for receiving at least the flat part of said insert, and said channel having grooves on each side thereof, starting at the proximal end of the holder for receiving the rails.

2. The safety knife according to claim 1 wherein:

said insert includes a catch at a distal end of the insert protruding towards the holder and said holder has an opening for receiving said catch.

3. The safety knife according to claim 2 wherein:

said catch is shaped as a button.

4. The safety knife according to claim 2 wherein:

said flat part of the insert includes a material which acts as a flat spring.

5. The safety knife according to claim 1 wherein:

said grooves have gaps located towards the distal end of the holder near the depression through which the rails can be entered.

6. The safety knife according to claim 1 wherein:

said insert includes a cavity for receiving the fixation near the proximal end of the insert.

7. The safety knife according to claim 1 wherein:

said fixation and said guard are shaped identically.

8. The safety knife according to claim 1 wherein:

said insert has a recess at the proximal end of the insert for receiving the tip of the holder.

9. The safety knife according to claim 1 wherein:

said holder has a bulge and said blade has a slot for receiving said bulge.

10. The safety knife according to claim 1 wherein:

said guard and said fixation extend beyond a cutting edge of the blade and are arranged so that they point towards each other in the direction of their extensions, forming an angle between 5 and 135 degrees.

11. The safety knife according to claim 1 wherein:

said depression is essentially perpendicular to the length of the holder and said guard is essentially parallel to the holder forming a cutting channel with essentially parallel sides.

12. The safety knife according to claim 1 wherein:

the angle formed by a cutting edge of the blade and the holder is an obtuse angle.

13. The safety knife according to claim 1 wherein:

a piercing tool is located either at the distal end of the holder or at the proximal end of the holder with essentially the same shape as a front end of the guard.

14. The safety knife according to claim 1 wherein:

a flat prying tool is located at the distal end of the holder.

* * * * *